US009115461B2

(12) United States Patent
Anderson et al.

(10) Patent No.: US 9,115,461 B2
(45) Date of Patent: Aug. 25, 2015

(54) DOOR WASH AID DISPENSER FOR A LAUNDRY TREATING APPLIANCE

(75) Inventors: Colin T. Anderson, Granger, IN (US); Fabian Garza De Leon, Stevensville, MI (US); Michael K. Lindquist, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 791 days.

(21) Appl. No.: 13/332,754

(22) Filed: Dec. 21, 2011

(65) Prior Publication Data

US 2013/0160215 A1 Jun. 27, 2013

(51) Int. Cl.
*D06F 37/28* (2006.01)
*D06F 39/02* (2006.01)

(52) U.S. Cl.
CPC ..... *D06F 37/28* (2013.01); *D06F 39/02* (2013.01)

(58) Field of Classification Search
CPC ..... D06F 39/022
See application file for complete search history.

(56) References Cited

U.S. PATENT DOCUMENTS

| | | | |
|---|---|---|---|
| 7,421,867 | B2 | 9/2008 | Bongini |
| 2006/0053842 | A1 | 3/2006 | Je |
| 2007/0022788 | A1 | 2/2007 | Choi et al. |
| 2007/0240456 | A1 | 10/2007 | Byun et al. |

FOREIGN PATENT DOCUMENTS

| | | | |
|---|---|---|---|
| DE | 1460888 | | 5/1969 |
| DE | 102009044711 | B3 | 4/2011 |
| EP | 1607507 | A1 | 12/2005 |
| EP | 1951947 | A1 | 8/2008 |
| EP | 2013400 | A2 | 1/2009 |
| EP | 2050858 | A1 | 4/2009 |
| EP | 2092104 | A1 | 8/2009 |
| EP | 2312040 | A1 | 4/2011 |
| GB | 2029862 | A | 3/1980 |
| GB | 2260770 | A | 4/1993 |
| KR | 20070111824 | A | 11/2007 |
| WO | 2004055253 | A1 | 7/2004 |
| WO | 2008044133 | A1 | 4/2008 |
| WO | 2010125538 | A1 | 11/2010 |

OTHER PUBLICATIONS

German Search Report for DE102012109972, Jun. 26, 2013.
German Search Report for counterpart DE102012110179, Jul. 2, 2013.

*Primary Examiner* — Jason Ko

(57) ABSTRACT

A laundry treating appliance may include a door supporting a wash aid dispenser. The door may be mounted for movement relative to a treating chamber and include a projection extending from a lower portion of the door on a side of the door facing the treating chamber. A wash aid receptacle for holding wash aid chemistry may be provided on the projection for dispensing of the wash aid chemistry into the treating chamber.

23 Claims, 6 Drawing Sheets

DOOR WASH AID DISPENSER FOR A LAUNDRY TREATING APPLIANCE

BACKGROUND

Laundry treating appliances, such as a clothes washer, typically use one or more wash aids, such as detergent, fabric softener, bleach, and oxidizers, to treat a load of laundry. The wash aid may be supplied by a user directly into a treating chamber of the laundry appliance or into a wash aid dispenser. Some common locations for the wash aid dispenser may include an opening located under the door and adjacent to the opening for the treating chamber in a vertical axis, top loading appliance and a slidable drawer positioned on the front panel of a horizontal axis, front loading appliance.

SUMMARY

A laundry treating appliance according to one embodiment for treating a laundry load according to at least one cycle of operation may comprise a drum at least partially defining a treating chamber with an open face, a door mounted for movement relative to the drum to selectively close the open face, a projection extending from a lower portion of the door on a side of the door facing the treating chamber and having a surface exposed to the treating chamber when the door is closed, and a wash aid receptacle provided on the surface and configured to hold at least a single dose of wash aid.

DESCRIPTION OF EMBODIMENTS OF THE INVENTION

Figure 1:
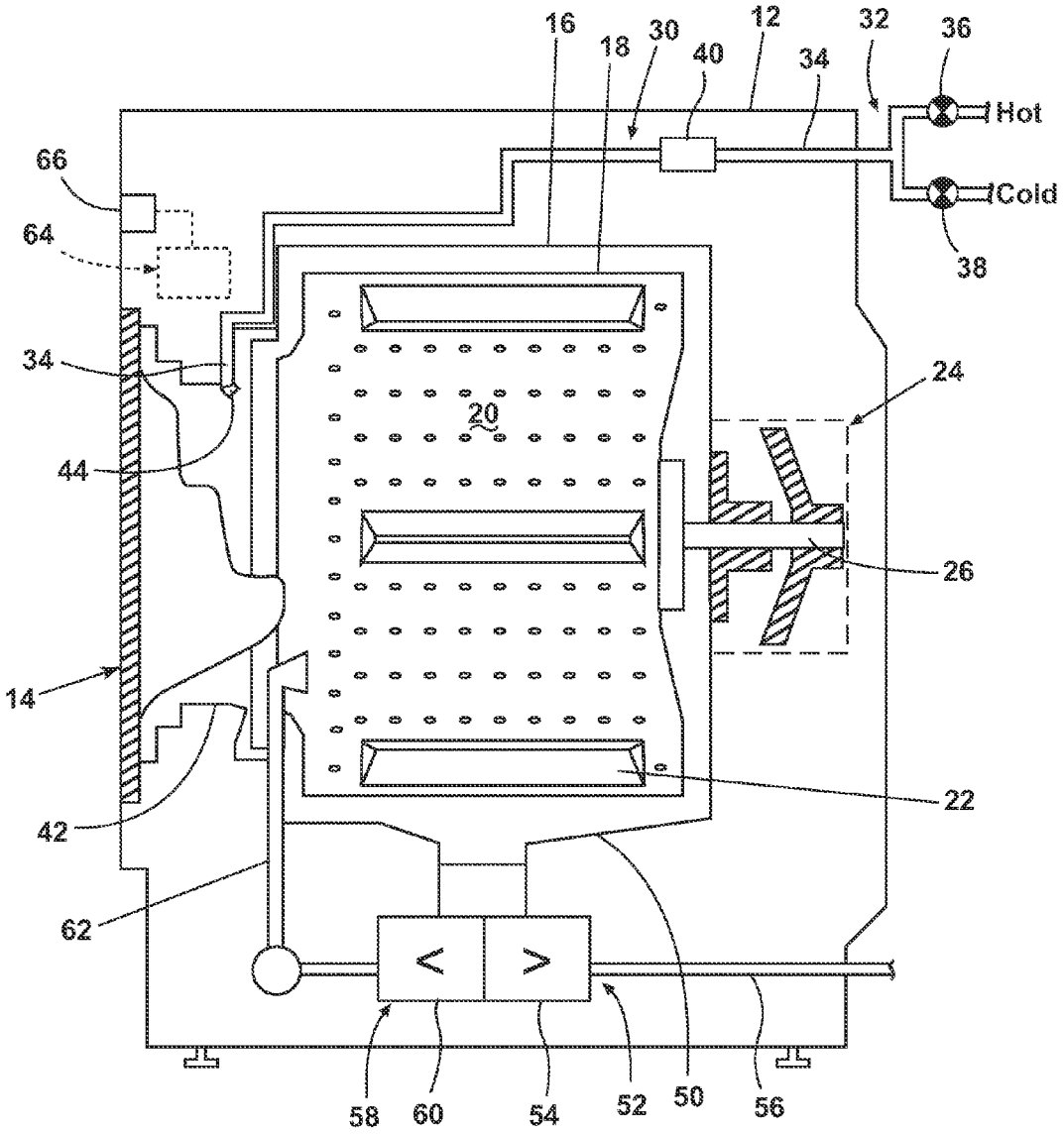
FIG. 1 is a schematic view of a laundry treating appliance in the form of a clothes washer according to one embodiment of the invention.

FIG. 1 is a schematic view of a laundry treating appliance in the form of a clothes washer 10 according to an embodiment of the invention. While the laundry treating appliance is illustrated as a horizontal axis clothes washer 10, the laundry treating appliance according to the invention may be any appliance which performs a cycle of operation on laundry, non-limiting examples of which include a vertical axis clothes washer, a combination washing machine and dryer, a tumbling or stationary refreshing/revitalizing machine, an extractor, a non-aqueous washing apparatus, and a revitalizing machine. The clothes washer 10 described herein shares many features of a traditional automatic clothes washer, which will not be described in detail except as necessary for a complete understanding of the invention. Although much of the remainder of this application will focus on the embodiment of an automatic clothes washer 10, the invention may have utility in other environments, including other cleaning appliances.

The clothes washer 10 may include a cabinet 12, which may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

A door 14 may be mounted to the cabinet 12 to selectively close an access opening to the interior of a liquid-holding, imperforate tub 16. The tub 16 may be supported within the cabinet 12 by a suitable suspension system (not shown). A drum 18 may be provided within the tub 16 and may have an inner periphery at least partially defining a treating chamber 20 with an open face for receiving fabric, such as laundry to be treated according to a cycle of operation. The drum 18 may be mounted for rotation within the tub 16 and may have perforations that permit the flow of liquid between the drum 18 and the tub 16.

The tub 16 and drum 18 may have aligned openings, which provide access to the treating chamber 20. The door 14 may be provided to selectively close at least one of the aligned openings to selectively provide access to the treating chamber 20 through the open face of the treating chamber 20. While the illustrated washing machine 10 includes both the tub 16 and the drum 18, with the drum 18 defining the treating chamber 20, it is within the scope of the invention for the clothes washer 10 to include only one receptacle, with the receptacle defining the treating chamber 20 for receiving the laundry load to be treated.

At least one lifter 22 may be provided in the drum 18 to facilitate movement of the laundry load within the drum 18 as the drum 18 rotates. The lifter 22 may be provided on the inner periphery of the drum 18. Multiple lifters 22 may be provided and may optionally be evenly spaced about the inner periphery of the drum 18.

The drum 18 may be coupled with a motor 24 through a drive shaft 26 for selective rotation of the drum 18 during a cycle of operation. It may also be within the scope of the invention for the motor 24 to be coupled with the drive shaft 26 through a drive belt for selective rotation of the drum 18. The motor 24 may rotate the drum 18 at multiple or variable speeds and in one direction or opposite rotational directions.

A liquid supply system 30 may also be included in the clothes washer 10 to supply liquid to the treating chamber 20. More specifically, liquid, such as water, may be supplied from a liquid source 32, such as a household water supply, to the clothes washer 10 by operation of at least one control valve controlling the flow of water through a supply or inlet conduit 34. As shown herein, separate valves 36, 38 may control the supply of hot and cold water, respectively, through the inlet conduit 34. A flow meter 40 may be positioned in the inlet conduit 34 and may have any suitable output representative of the flow of water through it. The inlet conduit 34 may direct the water from the liquid source 32 to the treating chamber 20, and as an example, the inlet conduit 34 may direct the water into the drum 18. As shown, the inlet conduit 34 may be coupled with a bellows 42 that couples the open faces of the tub 16 and the drum 18 with the cabinet 12, and the door 14 may seal against the bellows 42 when the door 14 closes the tub 16 and drum 18. The open face of the treating chamber 20 may coincide with an open face defined by the bellows 42 where the bellows 42 meets the cabinet 12.

The inlet conduit 34 may comprise a liquid dispenser in the form of a supply nozzle 44, for example, configured to supply the water into the treating chamber 20 along a flow path in a desired pattern and under a predetermined amount of pressure. For example, the supply nozzle 44 may be configured to supply a stream of water into the treating chamber 20 by gravity, i.e., a non-pressurized stream. The supply nozzle 44 may be mounted to the bellows 42 and be located in any desired position around the open face of the treating chamber 20. As an example, the supply nozzle 44 may be located at an uppermost position of the treating chamber 20, which would correspond to about the 12 o'clock position on the drum 18, to supply the liquid in a flow path generally downward toward the lowermost position of the treating chamber 20, which would correspond to about the 6 o'clock position on the drum 18.

Liquid in the treating chamber 20 may flow by gravity to a low portion or sump 50 of the tub 16. A liquid drain system 52 may be provided for draining liquid from the treating chamber 20. The liquid drain system 52 may include a drain pump 54 and a drain conduit 56. The drain pump 54 fluidly couples the sump 50 to the drain conduit 56 such that liquid in the tub 16 may be drained via the drain conduit 56. The drain conduit 56 may be coupled with a household drain.

An optional liquid recirculation system 58 may be provided for recirculating liquid to the treating chamber 20. As illustrated, the recirculation system 58 includes a recirculation pump 60 and a spray conduit 62. The recirculation pump 60 may fluidly couple the tub 16 to the spray conduit 62 such that liquid in the tub 16 may be supplied to the spray conduit 62, where it may be sprayed into the treating chamber 20. The recirculation pump 60 may be fluidly coupled to the sump 50 of the tub 16. The spray conduit 62 may direct the liquid from the recirculation pump 60 into the drum 18 in any suitable manner, such as by spraying, dripping, or providing a steady flow of the liquid. While the clothes washer 10 is illustrated as having separate drain and recirculation pumps 54, 60, in an alternative embodiment, the clothes washer 10 may include a single pump configured to selectively drain or recirculate liquid, such as by configuring the pump to rotate in opposite directions, or by providing a suitable valve system.

The clothes washer 10 may further include one or more devices for heating the liquid, such as a steam generator and/or a sump heater (not shown). The steam generator may be provided to supply steam to the treating chamber 20. The sump heater may be used to heat liquid in the sump 50. Alternatively, the sump heater may be used to heat laundry (not shown), air, the drum 18, or liquid in the tub 16 to generate steam, in place of or in addition to the steam generator. The steam generator may be used to heat the laundry as part of a cycle of operation, much in the same manner as sump heater, as well as to introduce steam to treat the laundry.

A controller 64 may be located within the cabinet 12 for controlling the operation of the clothes washer to implement one or more cycles of operation, which may be stored in a memory of the controller 64. Examples, without limitation, of cycles of operation include: wash, heavy duty wash, delicate wash, quick wash, refresh, rinse only, and timed wash. A user interface 66 operably coupled to the controller 64 may also be included on the cabinet 12 and may include one or more knobs, switches, displays, and the like for communicating with the user, such as to receive input and provide output. The user may enter many different types of information, including, without limitation, cycle selection and cycle parameters, such as cycle options. During operation of the clothes washer 10, the controller 64 may be operably coupled with one or more components of the clothes washer 10 for communicating with and controlling the operation of the component to complete a cycle of operation. For example, the controller 64 may be operably coupled with at least the motor 24, the valves 36, 38, the flow meter 40, the drain pump 54, and the recirculation pump 60 to control the operation of these and other components to implement one or more of the cycles of operation.

Figure 2:
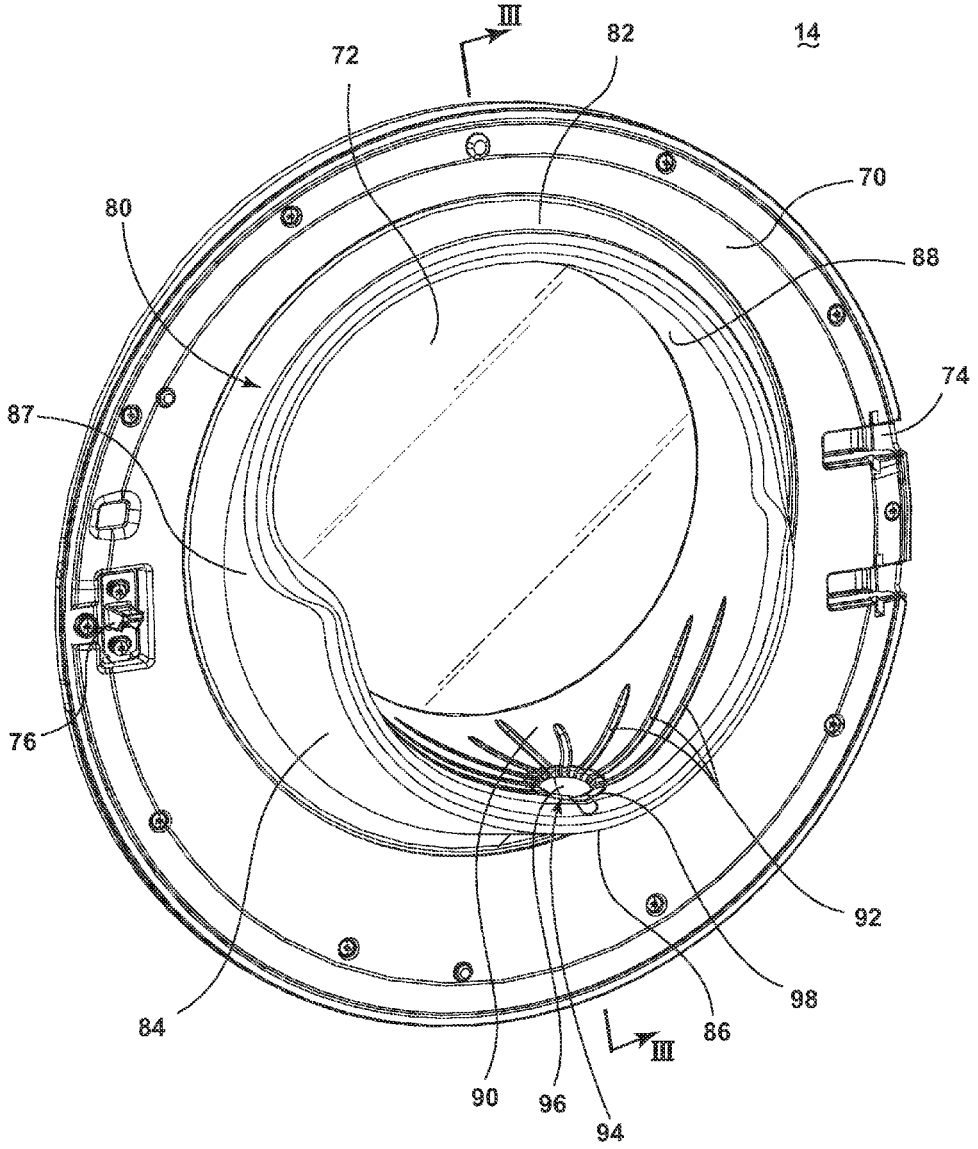
FIG. 2 is a rear perspective view of an embodiment of a door for the clothes washer according to one embodiment of the invention.

Referring now to the rear perspective view of the door 14 of the clothes washer 10 in FIG. 2, the door 14 may include a frame 70 surrounding a window 72. The door frame 70 is illustrated in the present embodiment as generally circular to accommodate a corresponding structure (not shown) on the cabinet 12, but it is to be understood that the door frame 70 may be any suitable shape, including generally rectangular so as to cover most or all of the front of the cabinet 12. The door frame 70 may be configured on one side with a hinge mount 74 that may receive a hinge assembly for movably mounting the door 14 to the cabinet 12 and may support a latch 76 on the opposite side for securing the door 14 to the cabinet 12 in the closed position. The window 72 may be substantially translucent so that a user may view the interior of the treating chamber 20 when the door 14 is closed. In an alternative embodiment, the window 72 may be omitted or opaque. Further, the window 72 may be circular in shape, as illustrated for exemplary purposes, and generally flat or planar. It is within the scope of the invention for the window to have any suitable shape and may correspond to the shape of the door 14. Further, the window 72 may be concave, convex, or of another curvature rather than flat or planar if desired.

The door 14 may further include a laundry baffle 80 on a rear side of the door 14, i.e., the side of the door 14 that faces the treating chamber 20 when the door 14 is closed. The baffle 80 may extend from the window 72 toward the treating chamber 20 and may be mounted to the window 72. Alternatively, the baffle 80 may be mounted to the frame 70, to both the frame 70 and the window 72, or may be integrally formed with the frame 70 or with the window 72. The baffle 80 may be generally round or have a ring configuration that surrounds the entire window 72 and may be sized for receipt within the open face of the bellows 42, as will be discussed in more detail below.

Figure 3:
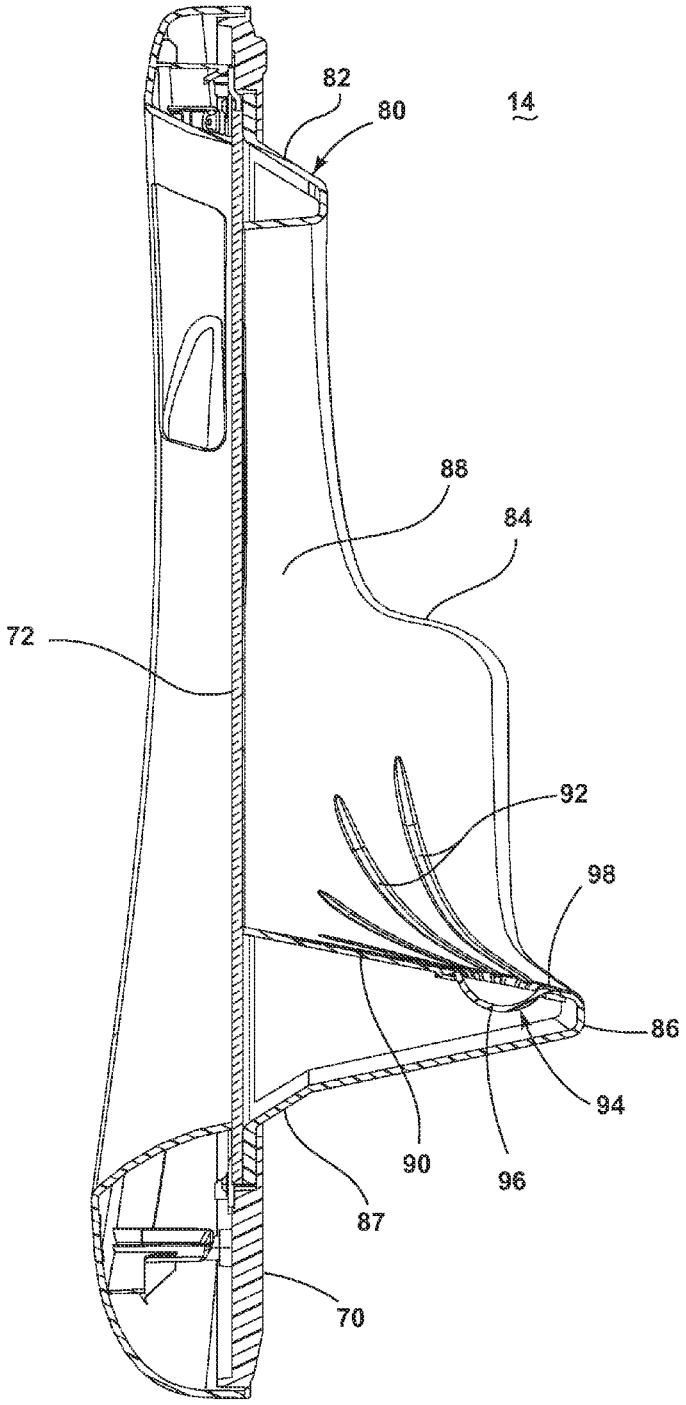
FIG. 3 is a sectional view taken along line III-III of FIG. 2.

As best seen in FIG. 3, which is a sectional view of the door 14, the baffle 80 may have a varying depth such that different parts of the baffle 80 project farther into the treating chamber 20, or conversely, farther away from the window 72, than other parts. The baffle 80 may include distinct sections, with each section having a corresponding depth, or the depth may vary continuously around the entire baffle 80. In the illustrated baffle 80, an upper portion 82 of the baffle 80 has the smallest depth, which, by example, is constant and extends along the upper half of the baffle 80, from about the 9 o'clock to about the 3 o'clock positions when moving clockwise. A projection 84 at a lower portion of the baffle 80 may have a larger depth such that it may project farther into the treating chamber 20. The projection 84 may extend along the lower half of the baffle 80, from about the 3 o'clock to about the 9 o'clock positions when moving clockwise and may include a protrusion 86 having a slightly greater depth at the lowermost portion of the baffle 80, about the 6 o'clock position. It is within the scope of the invention for the projection 84 to omit the protrusion 86 or have a different configuration and depth than that illustrated in the figures.

The baffle 80 may include an outer surface 87 and an inner surface 88 having a generally planar, downwardly inclined section 90 at the projection 84, including the protrusion 86, as visible in FIG. 3. The planar section 90 and one or more channels 92 formed in the projection 84 may function as liquid guides for directing liquid on the inner surface 88 of the baffle 80 toward a wash aid receptacle 94 supported by the projection 84, particularly by the protrusion 86 in the illustrated embodiment. The channels 92 may have any suitable configuration, including any suitable length, width, and depth, and may be located in any suitable pattern on the projection 84. The channels 92 may terminate at the wash aid receptacle 94, as illustrated, or may terminate at a location spaced from the wash aid receptacle 94, if desired.

The wash aid receptacle 94 may be positioned entirely within the protrusion 86, partially on the protrusion 86, or may not extend onto the protrusion 86, assuming, for illustrative purposes, that the projection 84 includes the protrusion 86. Further, the wash aid receptacle 94 may have any suitable form and is shown by example as having a generally arcuate depression 96 surrounded by a peripheral lip 98. The general shape may be oval, circular, rectangular, and other suitable shapes. The receptacle 94 may be a separate component mounted to the projection 84 or may be integrally formed with the projection 84. Further, the channels 92 may extend into the peripheral lip 98, if desired.

Regardless of form, the wash aid receptacle 94 may be configured to hold a supply of wash aid or treating chemistry. Wash aid chemistries may be provided in the wash aid receptacle 94 in any desirable form, such as a single charge, multiple charges (also known as bulk supply), or both. The wash aid chemistry may be in the form of, for example, a compressed block of powder, loose powder, liquid, gels, and the like. Further, the wash aid chemistry may be in the form of a pod having dissolvable packaging that contains the wash aid chemistry, which may itself have any suitable form, including the aforementioned powders, gels, and liquids. The pod may hold a single charge or multiple charges of the wash aid chemistry. When the wash aid chemistry is in the form of a pod or block, the user may simply place the pod or block into the wash aid receptacle 94, while other forms of wash aid chemistry may require the user to pour or otherwise dispense the wash aid chemistry into the wash aid receptacle 94. Examples of typical wash aid chemistries include, without limitation, detergent, fabric softener, bleach, oxidizers, and enzymes.

The operation of the clothes washer 10 will now be described with a focus on the operation of the door 14 and the wash aid dispensing system including the wash aid receptacle 94. The following description is provided for descriptive purposes only with the understanding that the operation may proceed in any suitable order and may be adapted according to variations of embodiments of the clothes washer 10.

Figure 4:
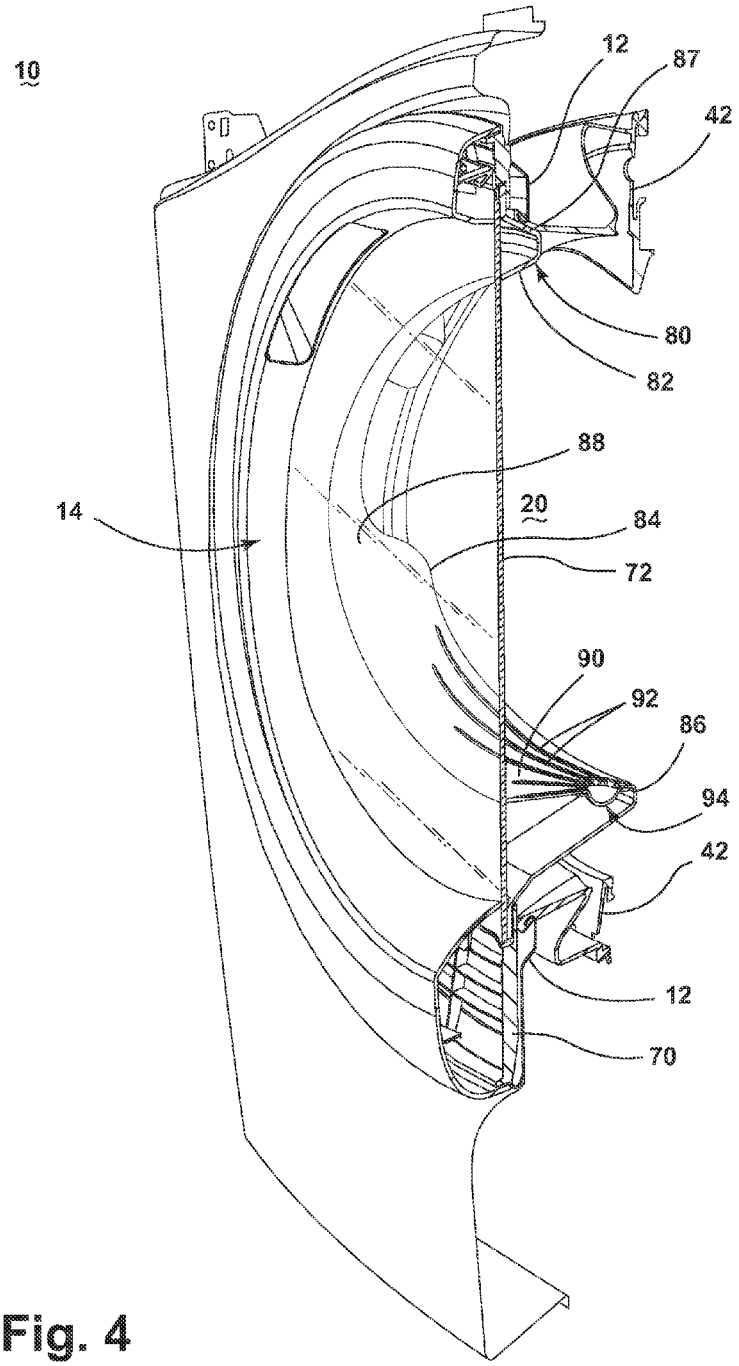
FIG. 4 is a sectional view similar to FIG. 3 with the addition of a cabinet and bellows for the clothes washer.

To use the clothes washer 10, the user typically opens the door 14 to load the laundry into the treating chamber 20, supplies the wash aid receptacle 94 with a desired wash aid chemistry, such as, for example, a detergent pod, and then closes the door 14. When the door 14 is closed, the door 14 closes the open face of the treating chamber 20, and the baffle 80 projects through the open face of the treating chamber 20 such that it overlies an edge of the open face and also seals against the bellows 42, as shown in FIG. 4, by the outer surface 87 abutting the bellows 42 around the entire circumference of the baffle 80. The seal between the baffle 80 and the bellows 42 inhibits the laundry from migrating through the open face of the treating chamber 20, thereby retaining the laundry load in the treating chamber 20, and the baffle 80 also prevents the laundry and possibly wash aid chemistry from entering the folds of the bellows 42. It also forms a fluid seal to prevent leakage of treating fluid out of the clothes washer 10 between the door 14 and the cabinet 12.

After providing instructions to the controller 64 regarding a desired cycle of operation through the user interface 66, the controller 64 initiates the desired cycle of operation. When dispensing of the wash aid chemistry occurs during the cycle of operation, water may be supplied through the liquid supply system, such as through the inlet conduit 34 to the supply nozzle 44. The supply nozzle 44 may be located at an upper portion of the bellows 42, as described earlier, above the wash aid receptacle 94 such that the water supplied to the treating chamber 20 flows along a liquid flow path from an upper portion of the door 14, where it is dispensed from the supply nozzle 44, toward the wash aid receptacle 94, as indicated by the dashes arrows labeled A in FIG. 5. The water may flow directly onto the wash aid dispenser 94 and the wash aid chemistry located therein, and some water may land or splash onto the projection 84 and flow toward the wash aid receptacle 94 with the possible aid of one or more of the liquid guides in the form of the sloped inner surface planar section 90 and the channels 92.

Figure 5:
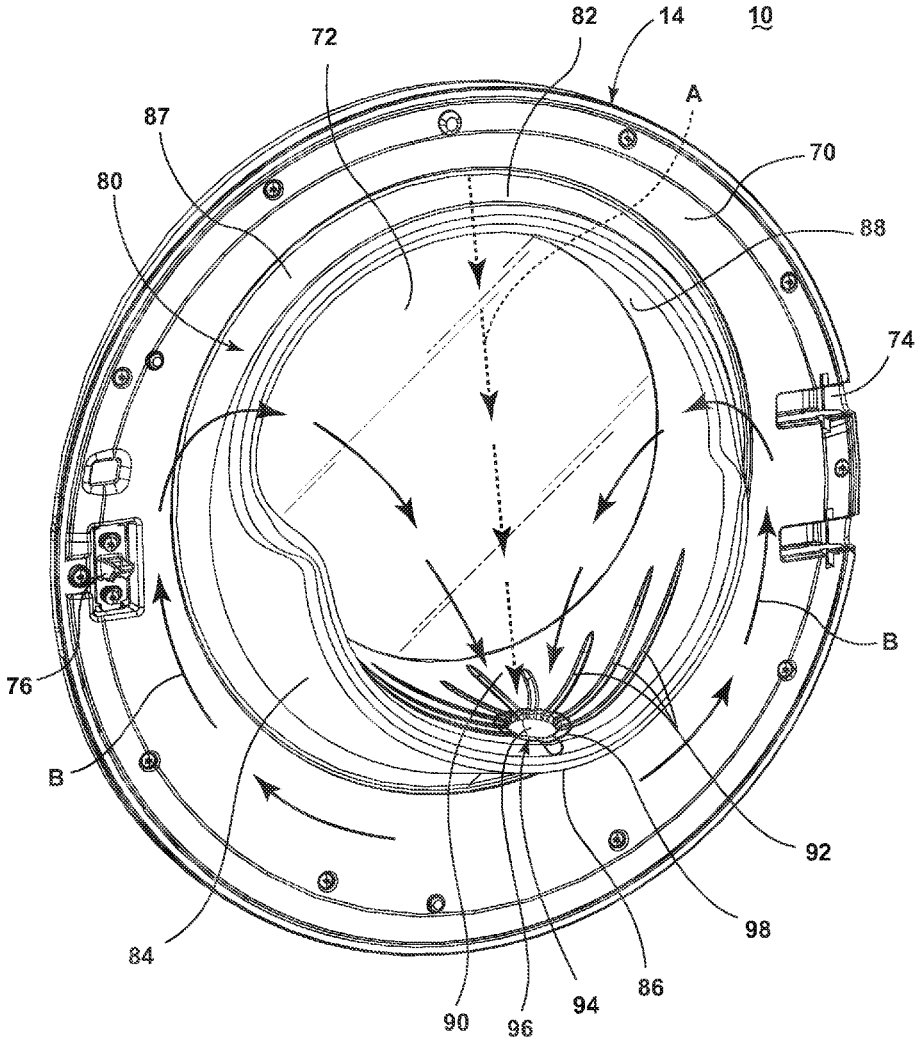
FIG. 5 is a perspective view similar to FIG. 2 illustrating liquid and laundry flow paths.

The dispensing of the wash aid chemistry may be assisted by rotation of the drum 18, which may cause at least a portion of the laundry to move along a laundry flow path indicated by the solid arrows labeled B in FIG. 5. The laundry flow path may be defined by the baffle 80 and its varying depth. For example, the laundry flow path may be such that the laundry moves upward generally circumferentially around the outer surface 87 of the baffle 80 to the upper portion 82 of the baffle 80 having the smallest depth, where the laundry turns and enters the interior of the baffle 80 before falling downward toward the planar section 90 of the projection 84 and into the drum 18. The laundry may fall onto the wash aid receptacle 94, may slide over the wash aid receptacle 94, and/or may cause water to splash onto the wash aid receptacle 94 and the wash aid chemistry contained therein.

The wash aid receptacle 94 may, therefore, be exposed to one or more elements that aid in dispensing the wash aid chemistry contained in the wash aid receptacle. Liquid that flows along the liquid flow path from the liquid source either directly or indirectly from the liquid guides, liquid that splashes onto the wash aid receptacle 94 due to rotation of the drum 18, and liquid that splashes onto the wash aid receptacle 94 due to movement of the laundry along the laundry flow path, along with the physical movement of the laundry on or near the wash aid receptacle 94 as it moves along the laundry flow path may aid in dispensing the wash aid chemistry. The liquid may dissolve packaging employed to contain the wash aid chemistry in the pod form and dissolve or erode wash aid chemistry in a powder or other solid form. Regardless of the form of the wash aid, the liquid and laundry may also physically force the wash aid chemistry out of the wash aid receptacle 94 and into the treating chamber 20, where the wash aid chemistry may be further dispersed among the laundry, mixed with liquid, and/or dissolved if necessary. When the door 14 includes the protrusion 86 or other surface adjacent the wash aid receptacle 94, the wash aid chemistry may move along the protrusion 86, which may be inclined as mentioned above, for dispensing into the treating chamber 20.

Figure 6:
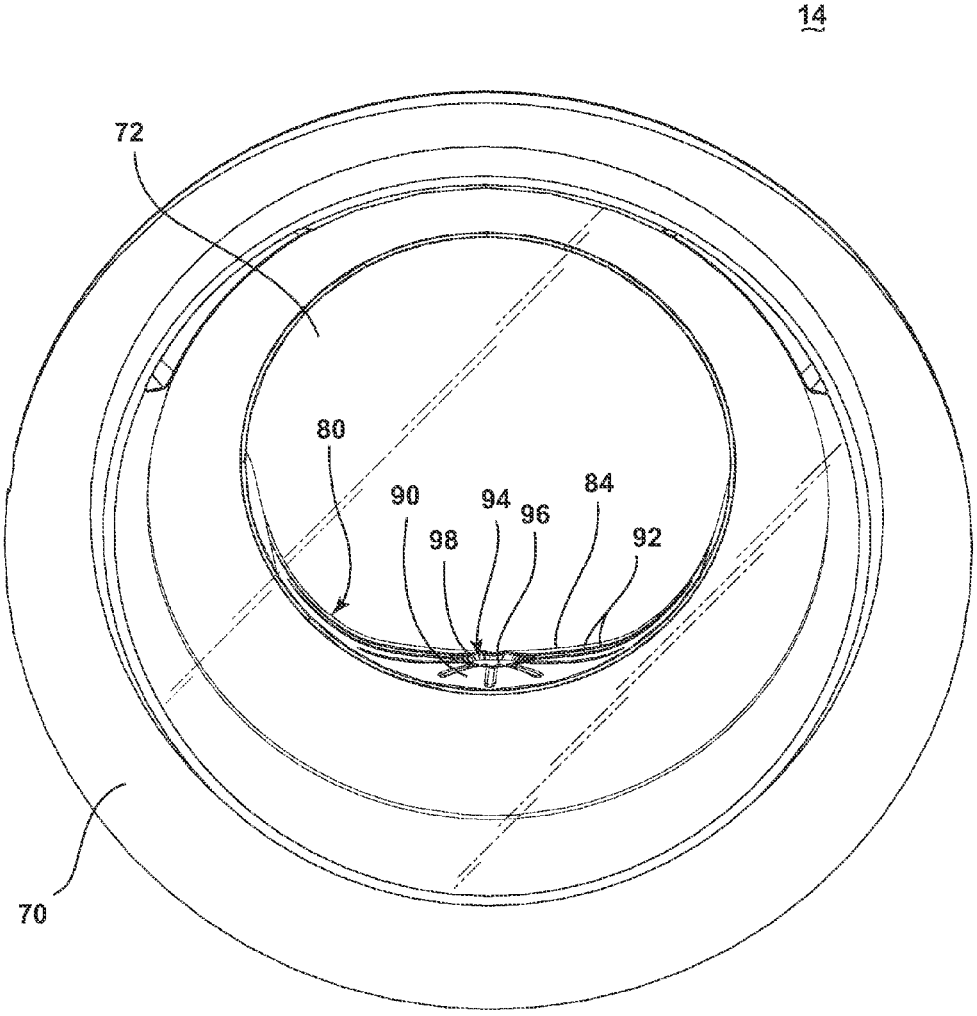
FIG. 6 is a tilted front view of the door of FIG. 2.

Referring now to the front view of the door 14 in FIG. 6, the door 14 may be configured so that the user may view the dispensing of the wash aid chemistry from the wash aid receptacle 94 through the window 72. The wash aid receptacle 94 may be visible through the window 72, and the user may be able to observe the presence of the wash aid chemistry in the wash aid receptacle 94, the dispensing of the wash aid chemistry into the treating chamber 20, and the substantial emptying of the wash aid receptacle 94 following the dispensing. This visual inspection may provide comfort to the user that the wash aid chemistry has been successfully added to the laundry and the liquid in the treating chamber 20. After the wash aid chemistry has been dispensed, the cycle of operation proceeds as determined by the controller 64.

It is to be understood that the door 14 and the wash aid dispenser may be modified as desired. For example, the wash aid receptacle 94 may be located on a structure other than the baffle 80 or on a baffle having a different configuration. For example, the projection 84 may extend from a lower portion of the door 14 without also including the baffle 80. Further, the laundry baffle 80 may be employed without the wash aid receptacle 94 and may be used with a different type of wash aid dispenser.

As another option, the channels 92 may be configured to scrub the laundry in a manner similar to a washboard as the laundry moves along the laundry flow path as shown in FIG. 5. Further, the channels 92 could be located in alternative or additional locations on the baffle 80, such as on the outer surface 87 of the baffle 80. The channels 92, regardless of location, may also be in the form of protrusions that are raised above the surface to facilitate guiding of the liquid (i.e., the liquid would flow between the protrusions), and/or scrubbing of the laundry.

While the invention has been specifically described in connection with certain specific embodiments thereof, it is to be understood that this is by way of illustration and not of limitation, and the scope of the appended claims should be construed as broadly as the prior art will permit.

What is claimed is:

1. A laundry treating appliance for treating a laundry load according to at least one cycle of operation, the appliance comprising:

a drum at least partially defining a treating chamber with an open face;

a door mounted for movement relative to the drum to selectively close the open face, the door having a frame, and a planar window mounted within the frame, the planar window being planar over its entirety and having a planar interior window surface exposed to the treating chamber when the door is closed;

a projection extending from a lower portion of the planar interior window surface on a side of the door facing the treating chamber, the projection having a top surface exposed to the treating chamber when the door is closed; and a wash aid receptacle provided on the top surface and configured to hold at least a single dose of wash aid.

2. The laundry treating appliance according to claim 1, further comprising a laundry baffle extending from the door on the side of the door facing the treating chamber inhibiting the laundry load from reaching the open face of the treating chamber when the drum is rotated, with the projection comprising part of the laundry baffle.

3. The laundry treating appliance according to claim 2 wherein the laundry baffle defines a laundry flow path along which the laundry moves when the drum rotates, and the wash aid receptacle is located in the laundry flow path.

4. The laundry treating appliance according to claim 3 wherein the laundry baffle comprises a ring having a varying depth, with a smaller depth at an upper portion of the ring and a larger depth at a lower portion of the ring defining the projection, to form the laundry flow path such that the laundry moves around the outside of the ring to the upper portion of the ring, enters the ring at the upper portion, and falls onto the projection.

5. The laundry treating appliance according to claim 2 wherein the door comprises a window, the projection extends from a lower portion of the laundry baffle, and the laundry baffle surrounds the window such that the wash aid receptacle is viewable from the side of the door not facing the treating chamber.

6. The laundry treating appliance according to claim 1 wherein the planar window comprises a translucent window.

7. The laundry treating appliance according to claim 6 wherein the projection is mounted to at least one of the frame and/or the window.

8. The laundry treating appliance according to claim 6 wherein the wash aid receptacle is visible through the window.

9. The laundry treating appliance according to claim 1 wherein the projection is arcuate, and the surface on which the wash aid receptacle is provided is a generally planar upper surface of the projection.

10. The laundry treating appliance according to claim 1, further comprising a cabinet that houses the drum and a bellows coupling the drum to the cabinet, wherein the projection extends from a part of the door that seals with the bellows when the door is closed.

11. The laundry treating appliance according to claim 10 wherein the projection projects farther into the treating chamber than the part of the door that seals with the bellows when the door is closed.

12. The laundry treating appliance according to claim 1, further comprising a liquid dispenser positioned to supply liquid into the treating chamber along a liquid flow path.

13. The laundry treating appliance according to claim 12 wherein the wash aid receptacle is located within the liquid flow path when the door is closed.

14. The laundry treating appliance according to claim 1 wherein the projection further comprises a liquid guide on the surface configured to direct liquid collected on the surface to the wash aid receptacle.

15. The laundry treating appliance according to claim 14 wherein the liquid guide comprises at least one channel formed in the surface and extending toward the wash aid receptacle.

16. The laundry treating appliance according to claim 15 wherein the liquid guide comprises a plurality of the channels.

17. The laundry treating appliance according to claim 14 wherein the liquid guide is formed by the surface being inclined downward toward the wash aid receptacle.

18. The laundry treating appliance according to claim 17 wherein the liquid guide comprises at least one channel formed in the inclined surface and extending toward the wash aid receptacle.

19. The laundry treating appliance according to claim 1 wherein the wash aid receptacle comprises an arcuate depression surrounded by a peripheral lip.

20. The laundry treating appliance according to claim 1, wherein the wash aid is dispensed from the wash aid receptacle without need for a water supply directed at or to the wash aid receptacle.

21. The laundry treating appliance according to claim 1, wherein the wash aid is dispensed from the wash aid receptacle responsive to at least one of laundry and/or recirculated water moving in the treating chamber.

22. The laundry treating appliance according to claim 1, wherein the projection extends from the bottom of the interior planar window surface on the side of the door facing the treating chamber.

23. The laundry treating appliance according to claim 1, wherein the projection extends from the bottom of the frame on the side of the door facing the treating chamber.

* * * * *